US009340964B2

(12) United States Patent
Stevens

(10) Patent No.: US 9,340,964 B2
(45) Date of Patent: May 17, 2016

(54) TOILET FLANGE ANCHOR

(71) Applicant: Michael Stevens, Conway, SC (US)

(72) Inventor: Michael Stevens, Conway, SC (US)

(73) Assignee: Michael Wayne Stevens, Conway, SC (US)

( * ) Notice: Subject to any disclaimer, the term of this patent is extended or adjusted under 35 U.S.C. 154(b) by 156 days.

(21) Appl. No.: 14/104,961

(22) Filed: Dec. 12, 2013

(65) Prior Publication Data

US 2015/0167284 A1 Jun. 18, 2015

(51) Int. Cl.
*E03D 11/16* (2006.01)

(52) U.S. Cl.
CPC ..... *E03D 11/16* (2013.01)

(58) Field of Classification Search
CPC . E03D 11/16; E03D 11/17; B60R 2011/0059; B60R 2011/0071; F16B 2/12
USPC ..... 248/229.12, 229.22, 228.3, 230.3, 248/231.41; 403/61; 4/252.4, 252.1
See application file for complete search history.

(56) References Cited

U.S. PATENT DOCUMENTS 4,830,203 A * 5/1989 Ennis ..... A47F 5/0846 211/105.2
5,822,918 A * 10/1998 Helfman ..... A47H 27/00 248/231.41

* cited by examiner

*Primary Examiner* — Janie Loeppke

(57) ABSTRACT

A toilet flange anchor provides a secure connection between a toilet flange and the floor when the hole in the floor about the flange is formed larger than the toilet flange itself. The toilet flange anchor includes first end that can be secured to the floor and a second end, adjustable in length, which can be secured to the toilet flange. The toilet flange anchor can be secured to the toilet flange with a screw and a T-nut, adjusted in length to allow the first end to reach the floor, the first end can then be attached to the floor with a screw and then the screw can be further tightened into the T-nut to form a secure connection between the toilet flange and the floor.

3 Claims, 3 Drawing Sheets

TOILET FLANGE ANCHOR

BACKGROUND OF THE INVENTION

The present invention relates to toilet flange anchors and, more particularly, to a toilet flange anchor that allows a toilet flange to be anchored to the floor when the hole around the flange is larger than the flange.

When a plastic toilet flange is installed, it must be secured to the floor by screws to prevent movement of the toilet and breakage of the flange. Typically, the flange will include holes about its perimeter to secure the flange to the floor with screws.

In some instances, the hole around the flange may be too large so that screws put through the holes about the perimeter of the flange will not be secured into the floor. In these cases, the only current way to deal with this problem is to patch the floor. This can add significant time and cost to a toilet installation project. If the flange installer is not able to add more flooring, an additional contractor may be needed for the installation.

As can be seen, there is a need for a toilet flange anchor that can be used to secure a toilet flange to a floor when the hole about the flange is larger than the span itself.

SUMMARY OF THE INVENTION

In one aspect of the present invention, a toilet flange anchor comprises an outer component having sides defining guides open at a first end of the outer component; an upper slot formed on an upper side of the outer component; a lower slot formed on a lower side of the outer component; a mounting hole formed through a second end of the outer component; an inner component fitting into the guides of the outer component; and a slot formed in the inner component.

In another aspect of the present invention, a toilet flange anchor comprises an outer component having sides defining guides open at a first end of the outer component; an upper slot formed on an upper side of the outer component; a lower slot formed on a lower side of the outer component; a mounting hole formed through a second end of the outer component; an L-shaped inner component fitting into the guides of the outer component; a slot formed in the inner component; a bolt fitting through the upper slot, the slot and the inner slot when the inner component is inserted in the guides of the outer component; and a nut fitting into the lower slot and operable to receive the bolt.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a toilet flange anchor that provides a secure connection between a toilet flange and the floor when the hole in the floor about the flange is formed larger than the toilet flange itself. The toilet flange anchor includes first end that can be secured to the floor and a second end, adjustable in length, which can be secured to the toilet flange. The toilet flange anchor can be secured to the toilet flange with a screw and a T-nut, adjusted in length to allow the first end to reach the floor, the first end can then be attached to the floor with a screw and then the screw can be further tightened into the T-nut to form a secure connection between the toilet flange and the floor.

Figure 1:
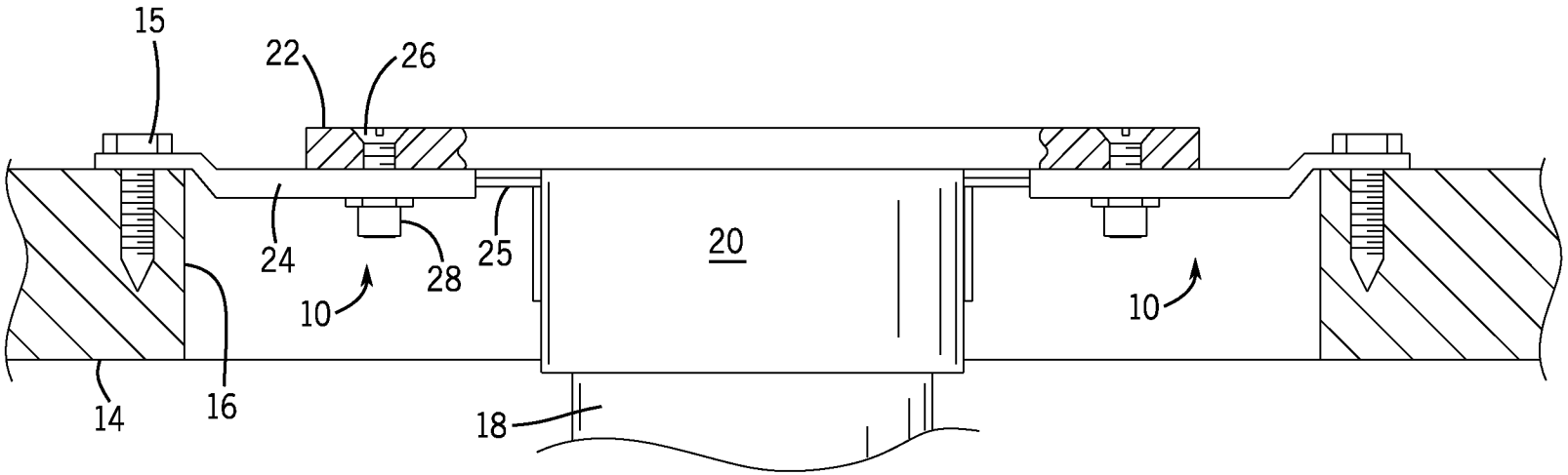
FIG. 1 is a partial cross-sectional view of a toilet flange anchor, installed between a toilet flange and a floor, according to an exemplary embodiment of the present invention.
Figure 2:
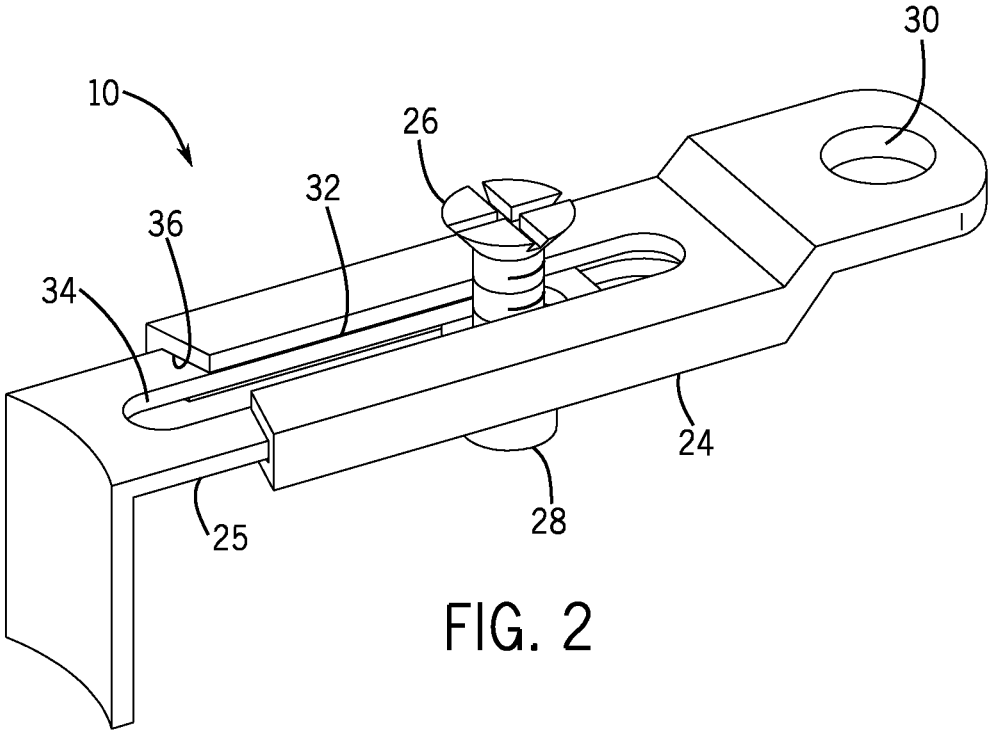
FIG. 2 is a top perspective view of the toilet flange anchor of FIG. 1.
Figure 3:
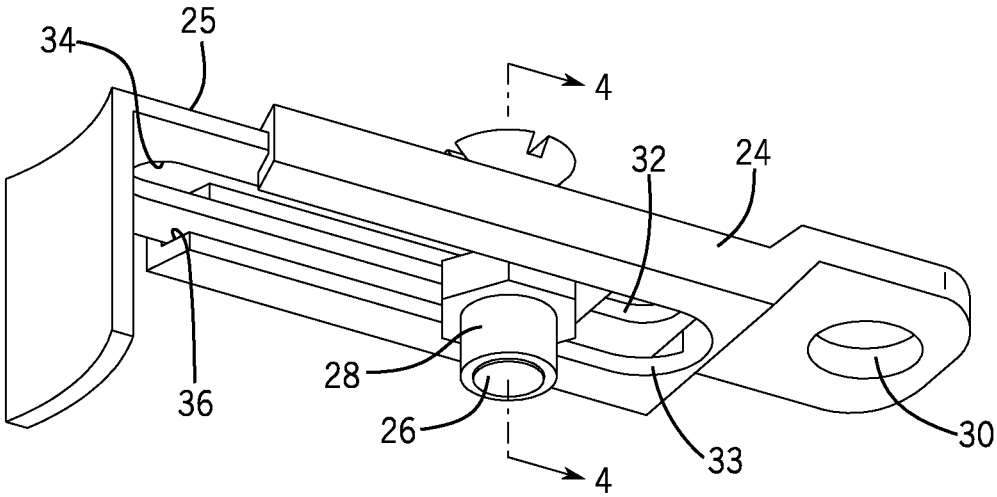
FIG. 3 is a bottom perspective view of the toilet flange anchor of FIG. 1.
Figure 4:
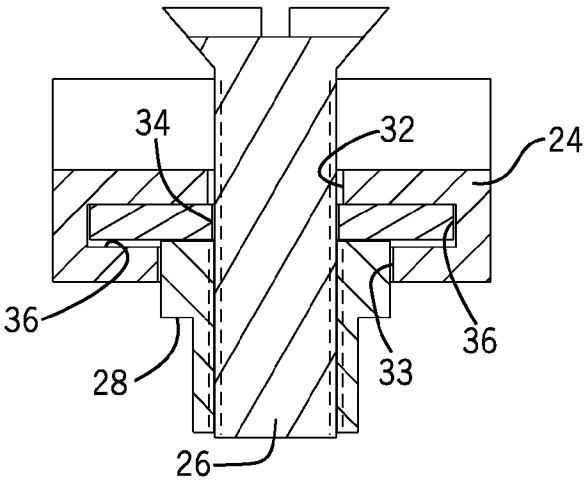
FIG. 4 is a cross-sectional view taken along line 4-4 of FIG. 3.
Figure 5:
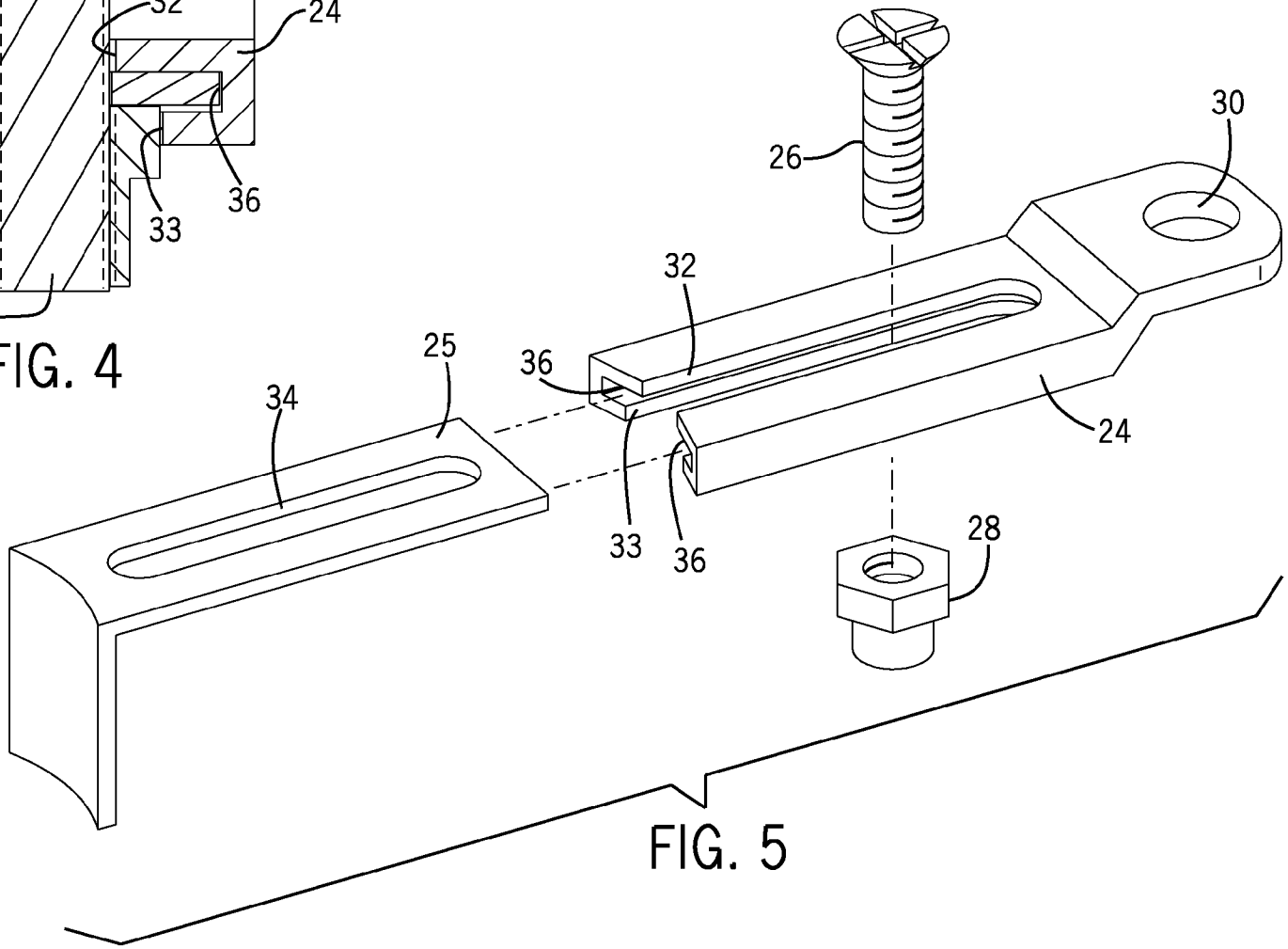
FIG. 5 is an exploded perspective view of the toilet flange anchor of FIG. 1.

Referring now to FIGS. 1 through 5, a toilet flange 20 is typically installed on an end of a waste pipe 18. The toilet flange 20 allows a toilet (not shown) to be secured thereto. For this reason, the toilet flange 20 must be secured to the floor 14. When the waste pipe 18 is installed, a hole 16 is cut. Sometimes, this hole 16 extends beyond the outer periphery of the toilet flange 20 and, therefore, the mounting portion 22 of the toilet flange 20 cannot be secured to the floor 14. Without proper support, a toilet attached to a toilet flange 20 that is not secured to the floor 14 may cause damage to the toilet flange 20 or the waste pipe 18, for example.

A toilet flange anchor 10 can span between the toilet flange 20 and the floor 14 at each location mounting location about the mounting portion 22 of the toilet flange 20.

The toilet flange anchor 10 can include an outer component 24 having an upper slot 32 and a lower slot 33 formed therein. The upper slot 32 and the lower slot 33 are disposed adjacent to each other to form generally C-shaped guides 36 along a length of the outer component 24. The upper slot 32 and the lower slot 33 typically extend to a first end of the outer component 24. However, in some embodiments, the upper slot 32 and the lower slot 33 may not extend all the way to the first end of the outer component 24.

A second, opposite end of the outer component 24 can include a mounting hole 30. The mounting hole 30 can be offset from and generally parallel to a plane defined by the upper slot 32 and the lower slot 33. Typically, the degree of offset would be approximately equal to a thickness of the mounting portion 22 of the toilet flange 20. However, should the toilet flange 20 be installed deeper than the floor 14 or be raised from the floor 14, the degree of offset may be changed to accommodate such installations.

An inner component 25 can fit into the guides 36 of the outer component 24 and slide in and out thereof. The inner component 25 can be formed in an L-shape. The portion of the inner component 25 that fits into the guides 36 can include a slot 34 formed therein. When the inner component 25 is disposed in the guides 36 of the outer component 24, the slot 34 aligns with the upper slot 32 and the lower slot 33 so that a bolt 26 can be inserted therein. A nut 28, such as a T-nut, can fit into the lower slot 33 and receive the bolt 26. The bolt 26 can be tightened in the nut 26 to fix the inner component 25 to the outer component 24.

To use the toilet flange anchor 10, a user can first attach the toilet flange anchor 10 to the toilet flange 20. The bolt 26 can pass through the toilet flange 20, through the upper slot 32 of the outer component 24, through the slot 34 of the inner component 25, and into the nut 26 secured in the lower slot 32 of the outer component 24. The bolt 26 can be tightened only to the extent to allow adjustment between the inner component 25 and the outer component 24.

The L-shaped inner component 25 can be extended from the outer component 24 until it presses against the toilet flange 20. The outer component 24 can be extended until the mounting hole 30 is positioned over the floor 14. A screw 15 can pass through the mounting hole 30 and be secured into the floor 14. Finally, the bolt 26 can be tightened to fully secure the toilet flange anchor 10 to both the floor 14 and the toilet flange 20.

The resulting installation of the toilet flange 20 with the toilet flange anchor 10 can save the installer from significant time and cost involved with extending the floor to meet the toilet flange 20.

It should be understood, of course, that the foregoing relates to exemplary embodiments of the invention and that modifications may be made without departing from the spirit and scope of the invention as set forth in the following claims.

What is claimed is:

1. A toilet flange anchor comprising:

an outer component having sides defining guides open at a first end of the outer component;

an upper slot formed on an upper side of the outer component;

a lower slot formed on a lower side of the outer component;

a mounting hole extending through a second end of the outer component, the mounting hole receiving a screw for releasably securing the toilet flange anchor to an existing floor;

an L-shaped inner component fitting into the guides of the outer component, the L-shaped inner component having a vertical portion positioned against a vertical portion of a toilet flange when installed;

a slot formed in the inner component;

a bolt operably inserted through a hole in a horizontal portion of the toilet flange and fitting through the upper slot, the slot formed in the inner component, and the upper slot when the inner component is inserted in the guides of the outer component; and a nut fitting into the lower slot for receiving the bolt to releasably secure the toilet flange anchor to the toilet flange.

2. The toilet flange anchor of claim 1, wherein the nut is a T-nut configured to prevent to prevent rotation of the nut when inserted in the lower slot of the outer component.

3. The toilet flange anchor of claim 1, wherein the second end of the outer component is offset and generally parallel from the first end of the outer component.

* * * * *